US009518796B2

(12) United States Patent
Carroll, Jr.

(10) Patent No.: US 9,518,796 B2
(45) Date of Patent: Dec. 13, 2016

(54) POWERED BOW HAVING AN INTERNAL ACCELERATION SYSTEM

(71) Applicant: Willard D. Carroll, Jr., Abilene, TX (US)

(72) Inventor: Willard D. Carroll, Jr., Abilene, TX (US)

( * ) Notice: Subject to any disclaimer, the term of this patent is extended or adjusted under 35 U.S.C. 154(b) by 0 days.

(21) Appl. No.: 14/259,334

(22) Filed: Apr. 23, 2014

(65) Prior Publication Data

US 2016/0040952 A1 Feb. 11, 2016

(51) Int. Cl.
*F41B 5/12* (2006.01)

(52) U.S. Cl.
CPC ..... *F41B 5/12* (2013.01)

(58) Field of Classification Search
CPC ..... F41B 5/12; F41B 5/123; F41B 5/1469; F41C 23/10
See application file for complete search history.

(56) References Cited

U.S. PATENT DOCUMENTS 1,261,992 A * 4/1918 Algie ..... F41B 3/005 124/21
2,918,050 A * 12/1959 Kopman ..... F41B 5/12 124/25
3,581,729 A * 6/1971 Jones ..... F41B 5/12 124/25
4,169,456 A 10/1979 Van House
4,388,914 A 6/1983 Cesin
4,662,345 A * 5/1987 Stephens ..... F41A 9/70 124/25
4,719,897 A * 1/1988 Gaudreau ..... F41B 5/1469 124/25
4,766,874 A 8/1988 Nishioka
4,947,822 A * 8/1990 Jones ..... F41B 5/12 124/25
6,273,078 B1 8/2001 Schwesinger
6,286,496 B1 * 9/2001 Bednar ..... F41B 5/1469 124/25
6,705,304 B1 * 3/2004 Pauluhn ..... F41B 5/12 124/25
8,104,461 B2 * 1/2012 Kempf ..... F41B 5/12 124/25
8,443,790 B2 * 5/2013 Pestrue ..... F41B 5/12 124/25
8,479,719 B2 7/2013 Bednar et al.
8,567,376 B2 10/2013 Flint
8,578,918 B1 11/2013 Islas
8,607,773 B1 12/2013 Schultz
(Continued)

*Primary Examiner* — Melba Bumgarner
*Assistant Examiner* — Amir Klayman
(74) *Attorney, Agent, or Firm* — Whitaker Chalk Swindle & Schwartz PLLC; Charles Gunter

(57) ABSTRACT

A leveraged bow for launching a projectile, the bow having a stock, a butt region and a grip region, and a fore-end supporting a pair of bow arms. The fore-end includes a top surface for receiving and supporting the projectile and a carriage assembly slidably mounted with an interior region of the fore-end. A main bow power string is coupled to the carriage. The carriage also has a launch string associated therewith which is powered by the movement of the main bow power string. A trigger and latch are used to release the bow power string and, in turn, the launch string to leverage the velocity of the arrow being propelled by the bow.

4 Claims, 11 Drawing Sheets

(56) References Cited

U.S. PATENT DOCUMENTS

| | | | | |
|---|---|---|---|---|
| 8,863,732 | B1 * | 10/2014 | Prior | F41B 5/123 124/25 |
| 2011/0308508 | A1 * | 12/2011 | Islas | F41B 5/105 124/25 |

* cited by examiner

POWERED BOW HAVING AN INTERNAL ACCELERATION SYSTEM

BACKGROUND OF THE INVENTION

1. Field of the Invention

The present invention relates generally to the field of archery and, more specifically, to an improved bow design in which an internal acceleration system achieves a greater projectile launch speed than was previously possible.

2. Description of the Prior Art

The field of archery dates back to antiquity. Long bows, cross bows and today's multiple variety of compound bows are familiar items to a large segment of enthusiasts involved in sporting and hunting activities. The term "bow" is used herein to mean a "mechanical accelerating device for projectiles," including hand bows for accelerating arrows in various forms including, for example, long bows, recurve bows, crossbows and compound bows used for accelerating arrows, bolts or balls as well as all other devices in which a projectile is accelerated with the aid of bows. Since the invention is intended to encompass various projectiles, such as arrows, bolts and balls, in the discussion which follows the terms "arrow" or "arrows" is often used alone but is intended to include all other suitable projectiles.

Modern crossbows now use sighting mechanisms of various sorts, but otherwise are little changed from antiquity, except in style and constructional materials. Draw weights are dramatically lower. A large medieval crossbow of circa 1500 AD might have a draw weight of 1200 lbs and a range of 450 yards. Today, a crossbow might not exceed 150 lbs draw weight. The basic elements are a short, horizontally mounted bow, a trigger mechanism (latch) to hold back the string, and the arrow which sits in a groove. Crossbows normally use rifle style stocks and the parts of the crossbow are often described in terms similar to those used to describe the parts of a rifle. Sights may be aperture sights as found on a rifle, pin sights as on a compound handbow, or telescopic sights. A modern 165 lb draw weight heavyweight crossbow will achieve similar projectile speeds to a 60 lb peak draw weight compound hand bow, and the bolt and arrow weights are also similar (30 gms). The crossbow, being relatively short compared to a vertical bow, will require comparatively more force to bend the bow.

While the traditional crossbow design has been around for hundreds of years, the basic design has certain inherent deficiencies. One of the major deficiencies is that the crossbow, as with the conventional bow, is limited in firing power by the maximum tension of which the bow is capable of achieving. It would be desirable to leverage the power of the conventional bow string to achieve an increase in the launch speed of the arrow or projectile being launched.

The present art is capable of achieving a launch speed on the order of 400 feet/second. An object of the present invention is to provide a powered bow capable of achieving launch speeds of 600 feet/second and greater.

These and other objects will be described more fully in the detailed description of the invention which follows.

SUMMARY OF THE INVENTION

The present invention has as one object to provide an improved bow design which uses the bow string as a primary source of power going to an internal leveraging system to provide increased leverage for launching a projectile at a velocity greater than previously attainable.

Another object is to reduce the necessary speed of the bow by leveraging the bow speed, thereby decreasing stress on the bow and prolonging the useful life of the bow.

Another object of the invention is to use the bow string to provide double, triple or greater leveraging of the projectile speed, without relying upon springs, gas cylinders, of the like.

Another object of the invention is to provide such a leveraging system which is internal to the crossbow, the system being located internally within a portion of the bow fore-end or stock.

Another object is to provide such an improved bow with a leveraging system which operates on the center line of the bow, rather than on the bow ends and yet has the ability to accelerate an arrow faster than previously possible.

The foregoing objects of the invention are accomplished by an improved bow design for launching a projectile having a novel acceleration leveraging feature. The bow has a standard stock with a butt region and a grip region. A fore-end extends longitudinally from a butt region of the stock. The fore-end terminates in a pair of oppositely extending bow limbs which are connected at outer extents thereof by a main power string of the bow. The fore-end also has an upper surface for receiving and supporting the projectile.

An acceleration mechanism is located in a hollowed out interior region of the fore-end. The acceleration mechanism includes a launch string which is separate from the main power string. The launch string has a traveling end which engages a rear portion of the projectile for propelling the projectile as the main bow string moves between a cocked position and a released position. The main bow string is operatively coupled to the launch string for propelling the launch string in leveraged fashion, movement of the main bow string causing acceleration of the launch string, which, in turn, causes the projectile to be launched from the upper surface of the body portion of the bow with increased velocity.

In a preferred version of the bow of the invention, the acceleration mechanism includes a carriage for operatively coupling the launch string and the main power string of the bow. The carriage is slidably mounted on a track formed within the interior region of the fore-end. In one preferred version of the invention, the launch string is provided with a fixed end, in addition to the traveling end, and an intermediate length, with the launch string passing about the carriage at one point along its length. The carriage has a central opening with the main bow string passing through the central opening so that movement of the main bow string propels the launch string and, in turn, the projectile. In other words, the traveling end of the launch string engages a rear portion of the projectile for powering the projectile. Movement of the main bow string propels the carriage in a forward direction as the carriage moves between the cocked and released positions, movement of the carriage causing acceleration of the launch string, which, in turn, causes the projectile to be launched from the upper surface of the body portion of the bow with increased velocity.

The bow also can be provided with a conventional style latch which is releasably engaged with the launch string, and with a trigger which is coupled to the latch. In one preferred version of the invention, the carriage comprises a pair of pulleys arranged side-by-side on the track in the interior of the body portion of the bow, the pulleys each having an outer circumferential groove for receiving a portion of the length of the launch string and a transversely arranged central opening for receiving the main power string of the bow. In this version of the invention, the launch string forms a loop between the fixed end and the traveling end thereof, the loop being in contact with a rear portion of the projectile for propelling the projectile as the launch string moves between the cocked and released positions of the bow.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
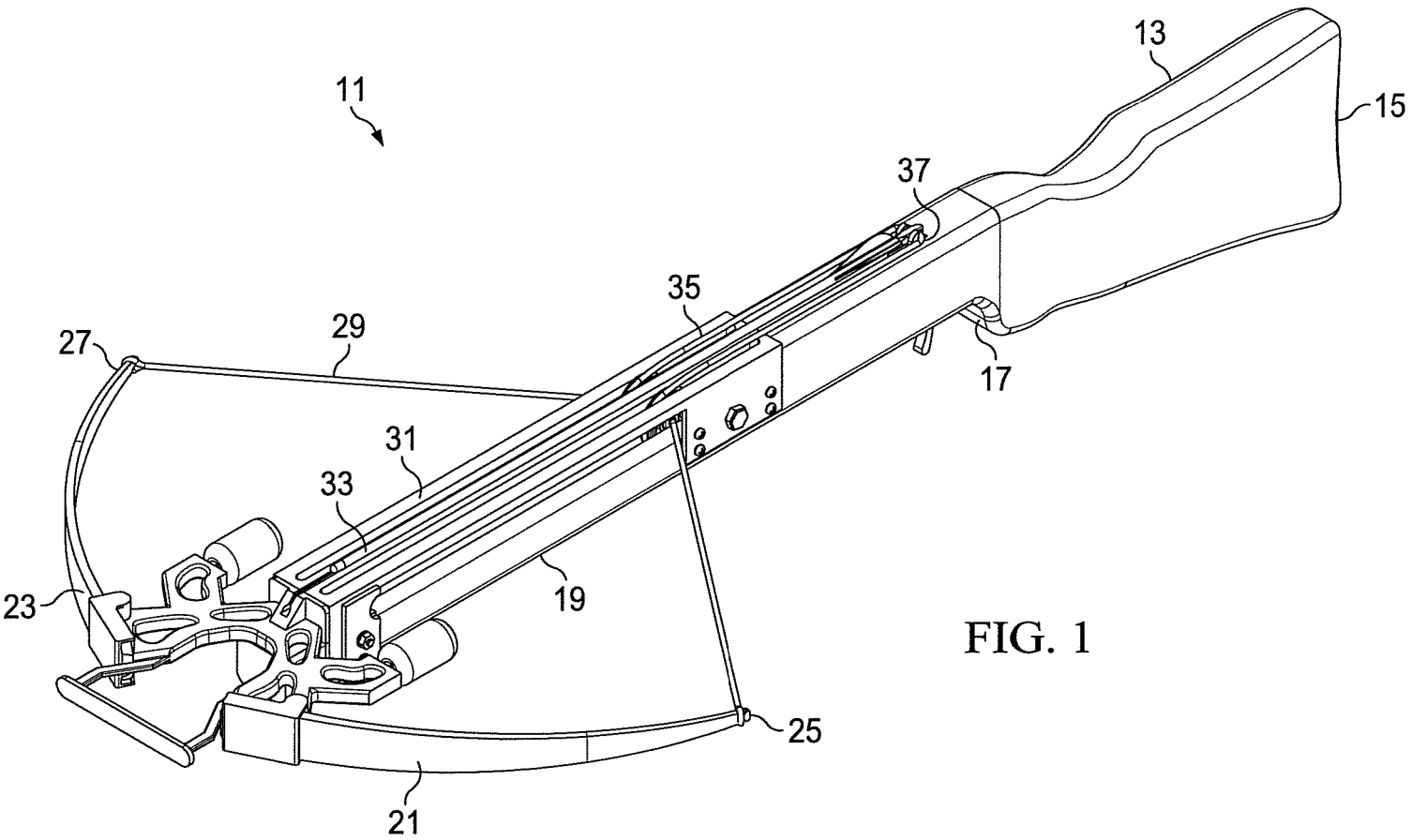
FIGS. 1-3 are perspective views of a crossbow embodying the principles of the present invention, showing the bow from various angles and with the bow in the cocked position ready to fire a projectile arrow.

FIGS. 1-10 show the improved bow of the invention in the cocked or ready position. FIGS. 11-20 show the same bow, but in the shot or released position. With reference now first to FIG. 1, there is shown a bow of the invention designated generally as 11. The invention will be described primarily in terms of a "crossbow." A crossbow will be understood to be a weapon of the type previously described having a bow mounted on a stock that shoots projectiles, such as conventional arrows. It will be apparent to those skilled in the relevant arts that the principles of the invention could also be applied to other bow types, including the presently popular "compound" bows. The crossbow design shown in the drawing was chosen primarily for ease of illustration.

Figure 2:
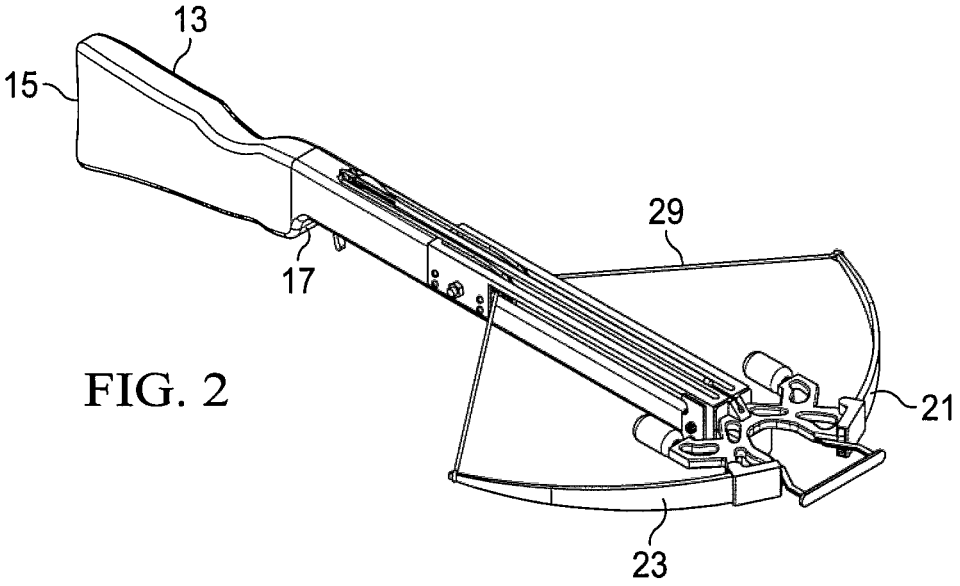
Figure 3:
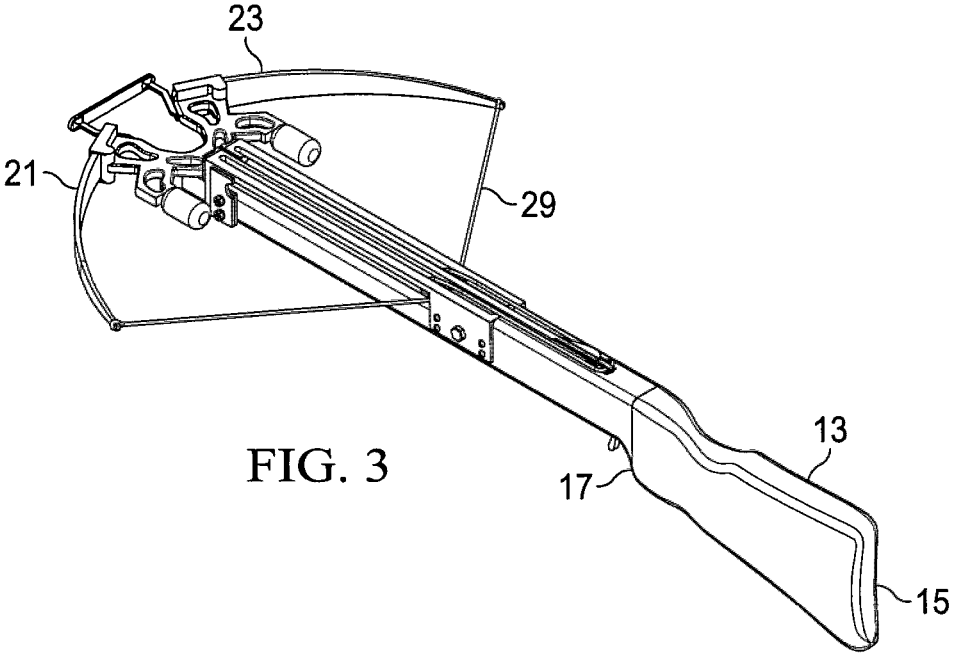
Figure 4:
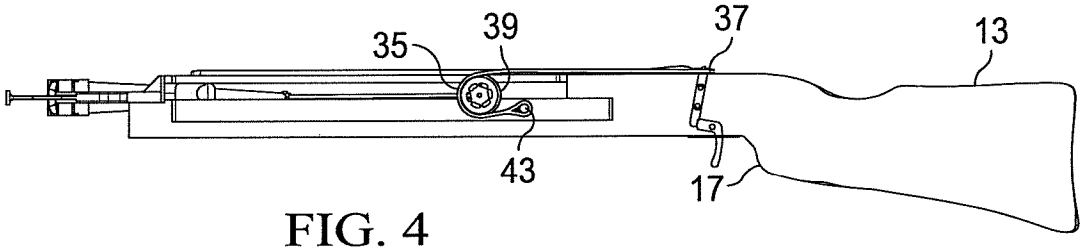
FIG. 4 is a side view of the bow of FIG. 1, partly broken away to show the operative elements thereof.
Figure 5:
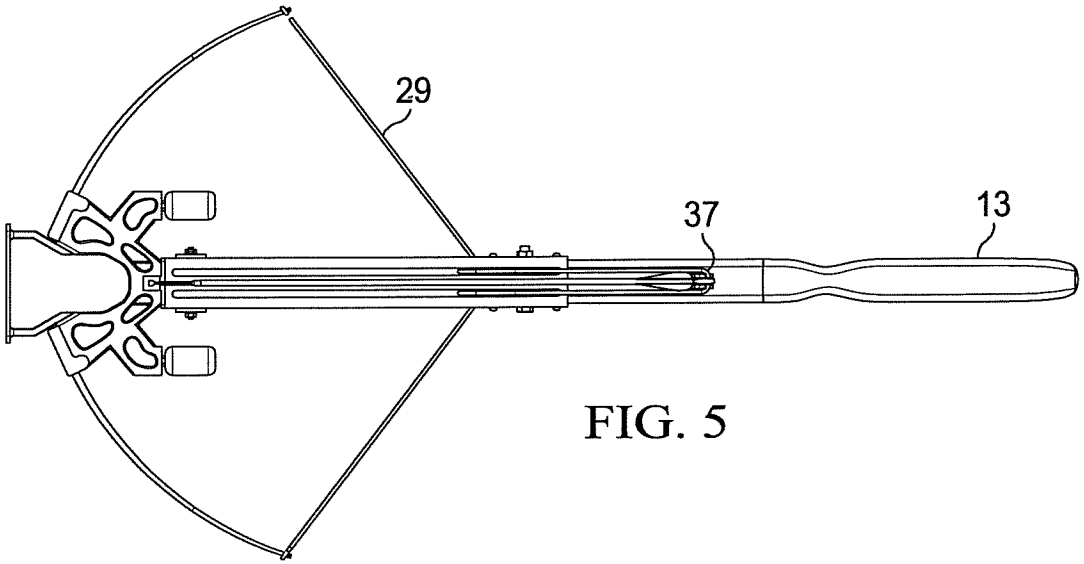
FIG. 5 is a top view of the bow of FIG. 4.
Figure 6:
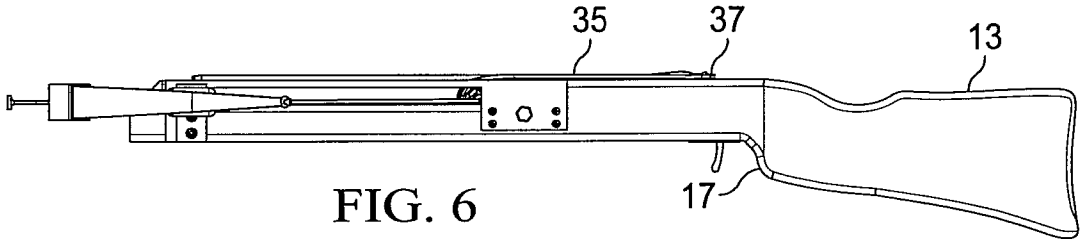
FIGS. 6 and 7 are additional side views of the bow of FIG. 1 showing the bow in the cocked position, with portions broken away for ease of understanding.
Figure 7:
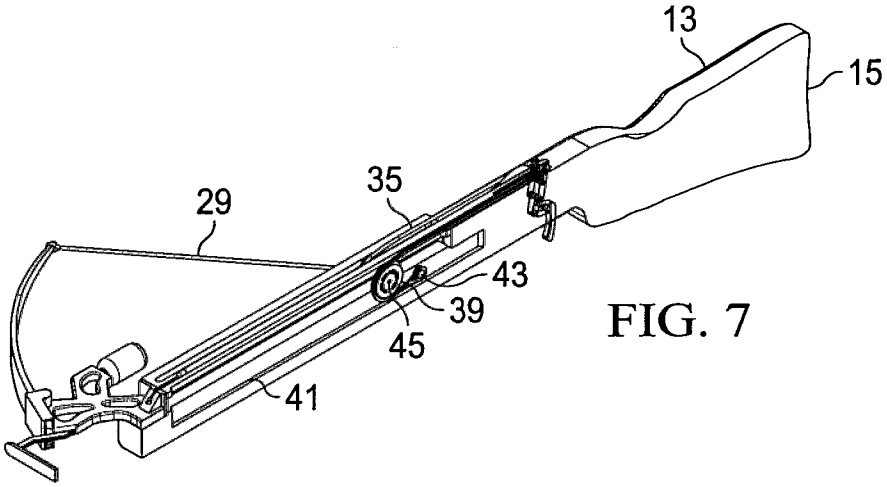

With reference first primarily to FIGS. 1-3, the crossbow 11 of the invention has certain features which are conventional in such bow designs and which will be familiar to those skilled in the relevant arts. Thus, the bow 11 has a stock 13 with a butt region 15 and a grip region 17. The bow also has a fore-end (generally at 19) which extends longitudinally from the butt region 15 in the same general plane. The fore-end 19 terminates in a pair of oppositely extending bow limbs 21, 23, which are connected at outer extents 25, 27, thereof by a main power string 29 of the bow. The fore-end also has an upper surface 31 for receiving and supporting a projectile, such as the arrow 33. In the example shown, the arrow is received within a longitudinal groove which is formed in the upper surface 31 and which runs along the length thereof.

The powered bow design of the invention also has a number of features which are novel over the known art and which will now be described in greater detail. As will be apparent from the drawings, particularly FIGS. 4-7, the fore-end 19 has a hollowed out interior region which contains components of a novel acceleration mechanism. The acceleration mechanism shown in FIGS. 4-7 includes a launch string 35 which is separate from the main power string 29. The launch string has a traveling end 37 which engages the projectile for propelling the projectile as the main bow string moves between a cocked position and a released position. For instance, in the case of an arrow, the launch string may engage the arrow "notch" located at the rear end of the arrow. FIGS. 1-10 show the bow in the cocked position. In the cocked position, the main power string 29 of the bow 11 is operatively coupled to the launch string 35 for propelling the launch string 35 in leveraged fashion. In other words, movement of the bow main power string 29 causes acceleration of the launch string 35, which, in turn, causes the projectile 33 to be launched from the upper surface 31 of the fore-end of the bow with increased velocity.

This "leveraging" aspect of the operation of the acceleration mechanism of the bow will now be described in greater detail. In the version of the invention illustrated in FIGS. 1-10, the acceleration mechanism includes a carriage (39 in FIG. 4) which is slidably mounted on a track (41 in FIG. 7) formed within the interior region of the fore-end 19. By "within the interior region of the fore-end" is meant any location generally forward of the grip region. The track 41 extends longitudinally along the length of the fore-end in a common plane therewith. In this version of the invention, the launch string 35 has a fixed end which is fixed at the point 43 in FIGS. 4 and 7, in addition to the traveling end 37, and an intermediate length. The intermediate length of the launch string passes about the carriage 39 at one point along its length and extends backwards along the upper surface 31 to engage the arrow.

Figure 8:
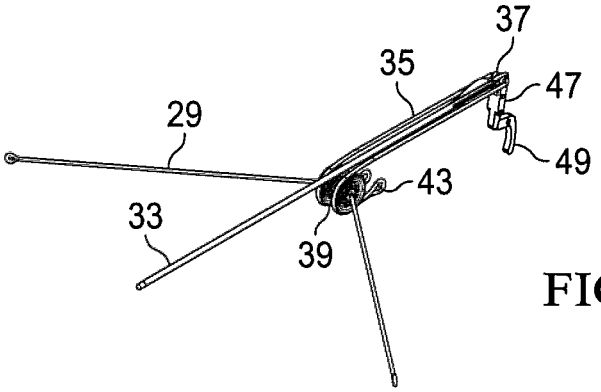
FIGS. 8-10 are isolated views of the acceleration mechanism used in the bow of the invention to leverage the bow main power string and achieve greater launch velocity of the arrow or projectile.
Figure 9:
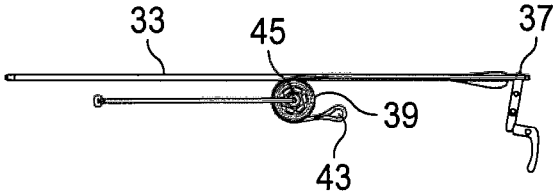
Figure 10:
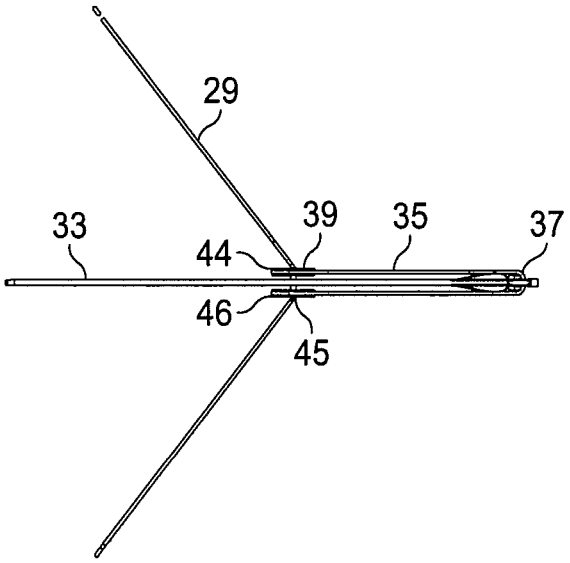
Figure 11:
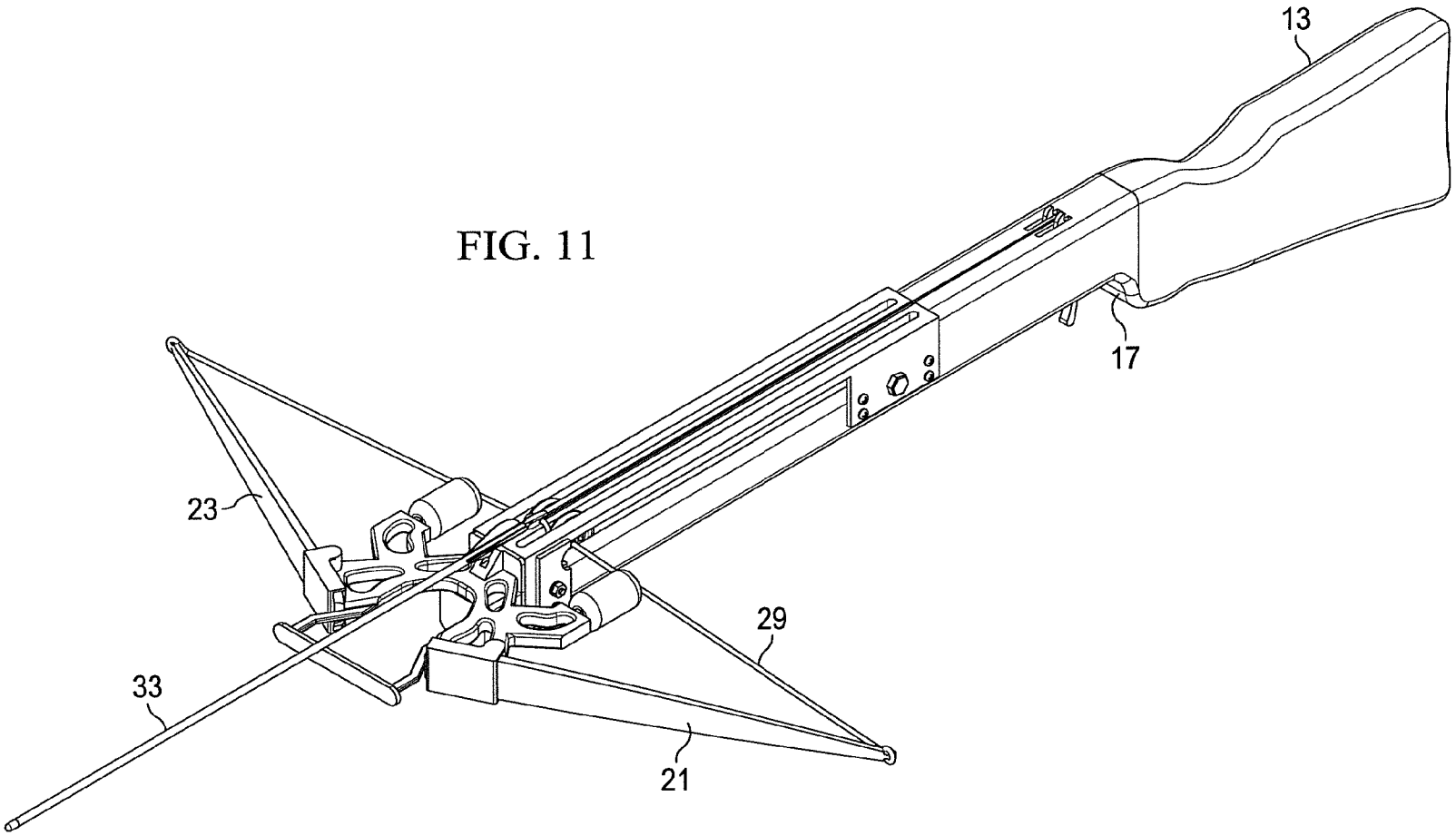
FIG. 11 is a perspective view of the bow of the invention, similar to FIG. 1, but showing the bow in the released position just as the arrow is being launched.
Figure 12:
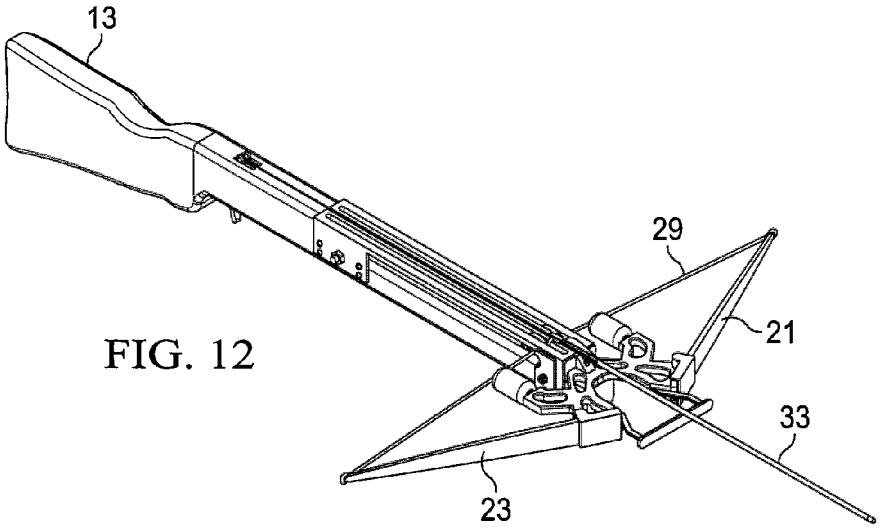
FIGS. 12-17 are views similar to FIGS. 2-7, but showing the bow in the released position, rather than the cocked position.
Figure 13:
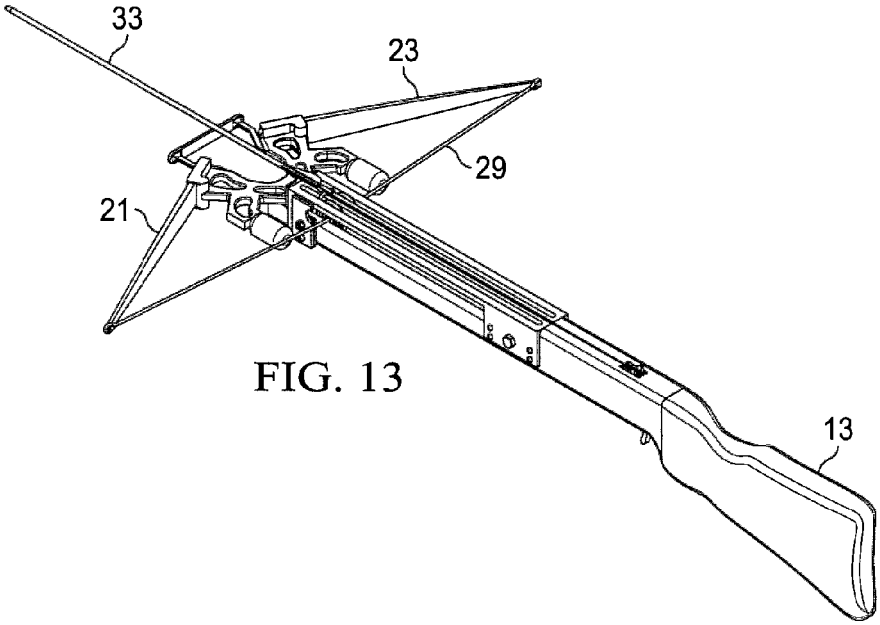
Figure 14:
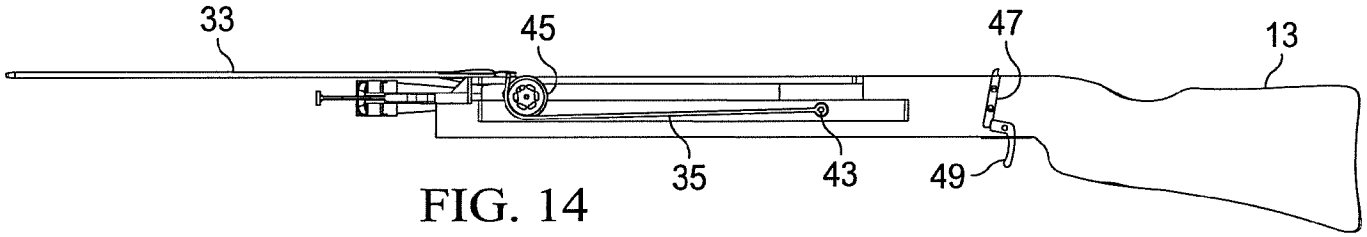
Figure 15:
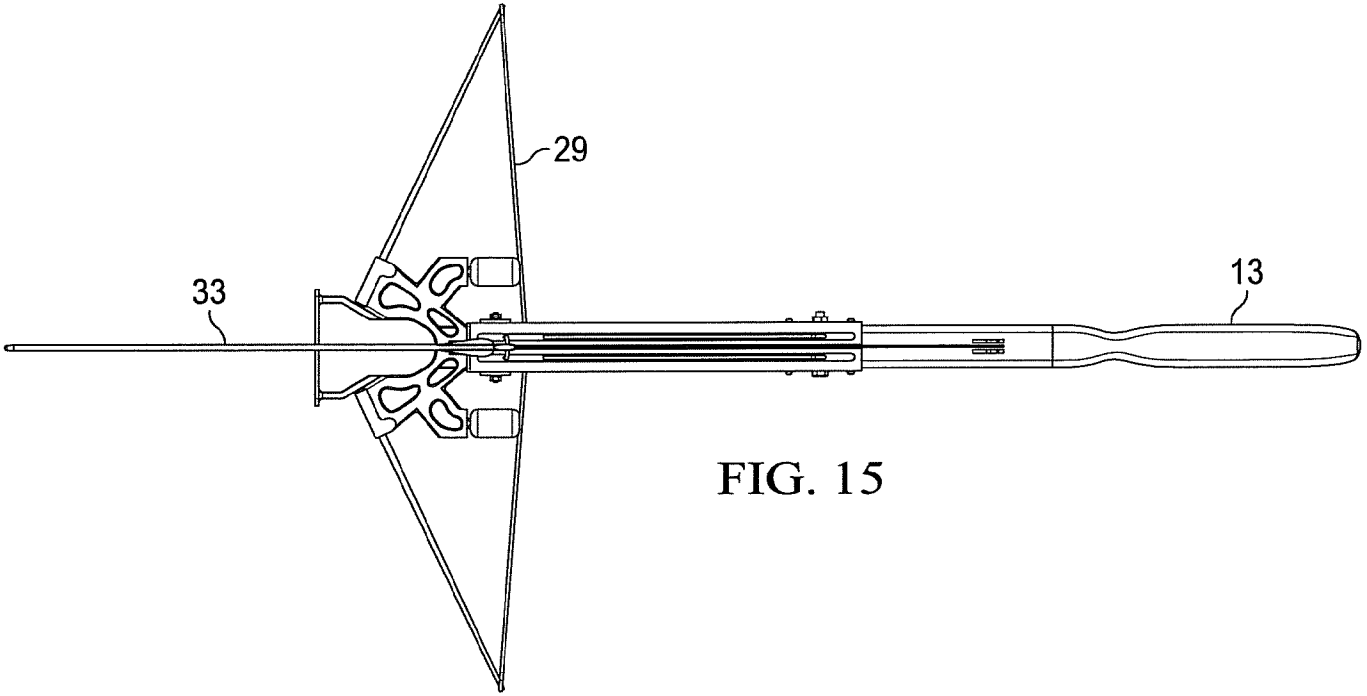
Figure 16:
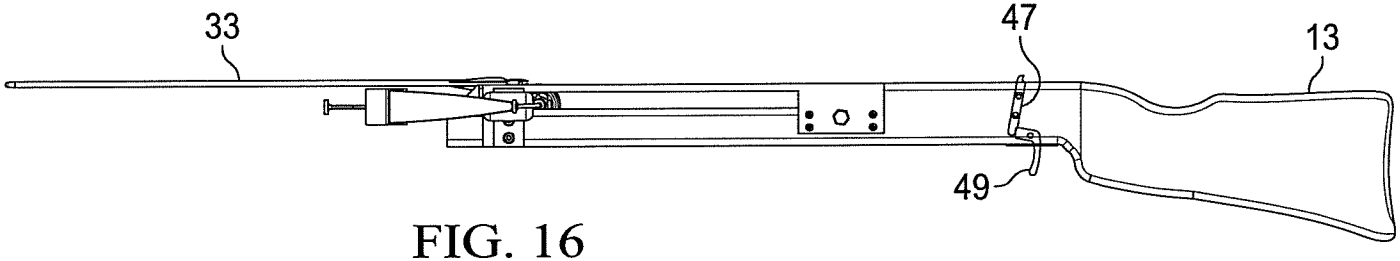
Figure 17:
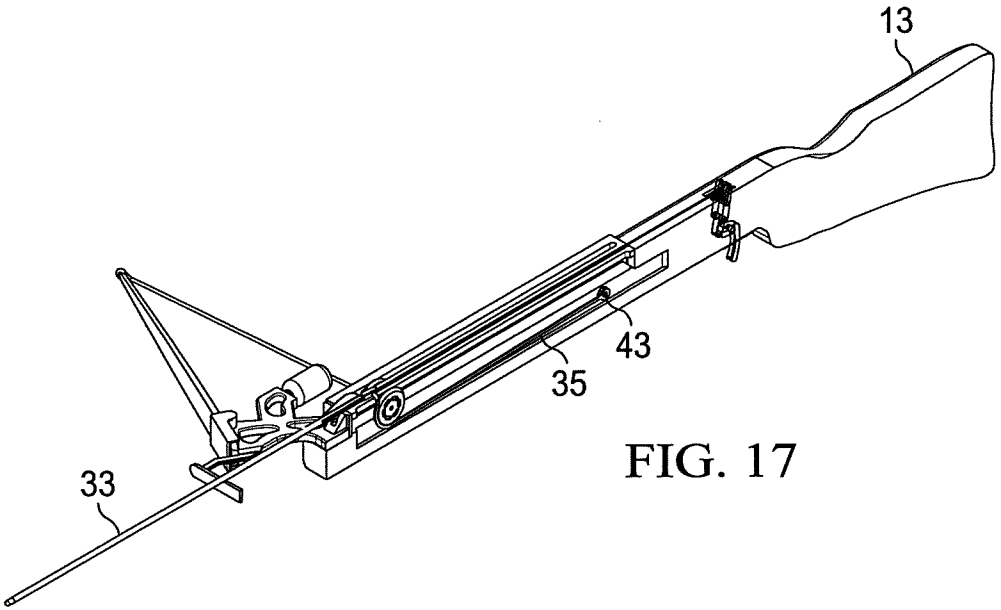
Figure 18:
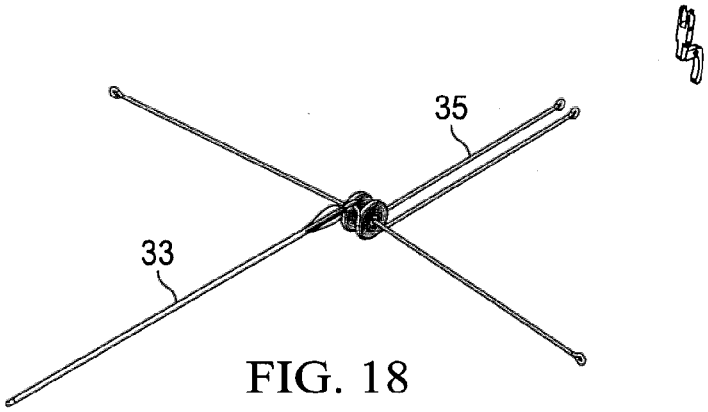
FIGS. 18-20 are isolated, schematic views of the launch mechanism of the bow, showing the bow launch string and main power string just as the arrow is being launched from the bow.
Figure 19:
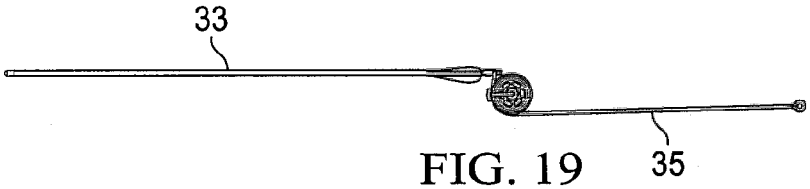
Figure 20:
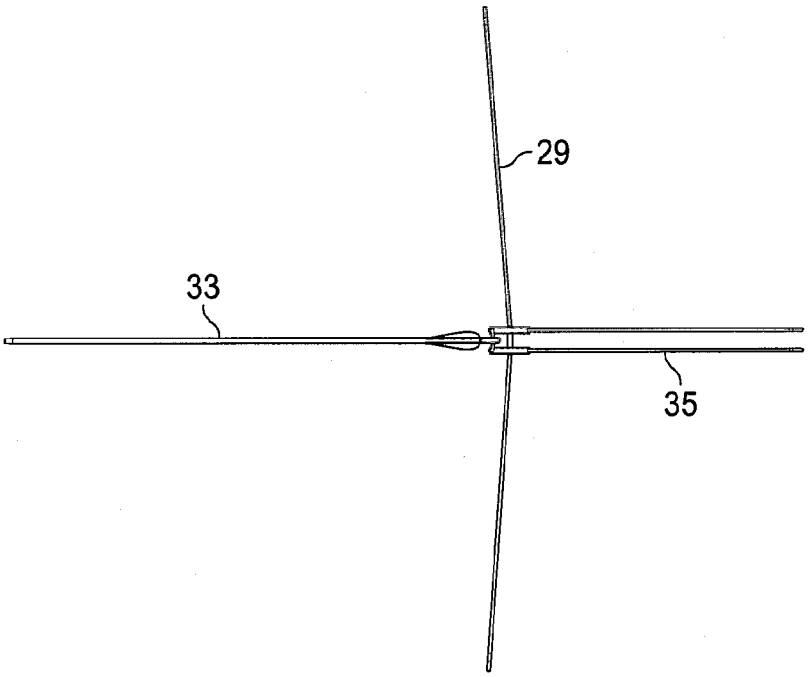

As perhaps best seen in the isolated and partly schematic views of FIGS. 8-10, the launch string 35 actually forms a loop between the fixed end 43 and the traveling end 37, the traveling end engaging the rear portion of the arrow in the arrow notch. As perhaps best seen in FIGS. 8 and 10, in one preferred form of the invention, the carriage is made up of a pair of pulleys (44, 46 in FIG. 10) arranged side-by-side on the track (41 in FIG. 7) in the interior of the fore-end of the bow. The pulleys 44, 46, each have an outer circumferential groove for receiving a portion of the length of the launch string and a transversely arranged central opening 45 for receiving the main power string 29 of the bow. FIGS. 9 and 10 illustrate the central opening (45 in FIGS. 9 and 10) which the main bow string 29 passes through, whereby movement of the main bow string 29 propels the launch string 35 and, in turn, the arrow 33. Movement of the main bow string 29 propels the carriage 39 in a forward direction as the carriage 39 moves between the cocked and released positions of the bow. Movement of the carriage 39 causes acceleration of the launch string 35, which, in turn, causes the arrow 33 to be launched from the upper surface of the fore-end of the bow with increased velocity.

The practical effect of the design of the acceleration mechanism of the invention is that, when the launch string 35 moves forward, the power string 29 moves twice as fast. This allows the improved crossbow of the invention to achieve increased projectile launch velocities on the order of 600 feet/second and greater, as compared to a convention cross bow having a launch velocity which might be on the order of 400 feet/second. An analogy might be made to a reverse block and tackle where, for example, each foot being pulled might raise a load one half foot. In the case of a 2:1 leverage block and tackle system, 100 pounds of pull force might be leveraged to 200 pounds. The present design is, in effect, doing exactly the opposite, using one half the power to deliver twice the arrow speed. This also means that for a 500 pound draw weight bow, instead of having to cock 500 pounds, it is only necessary to cock 250 pounds.

Figure 21:
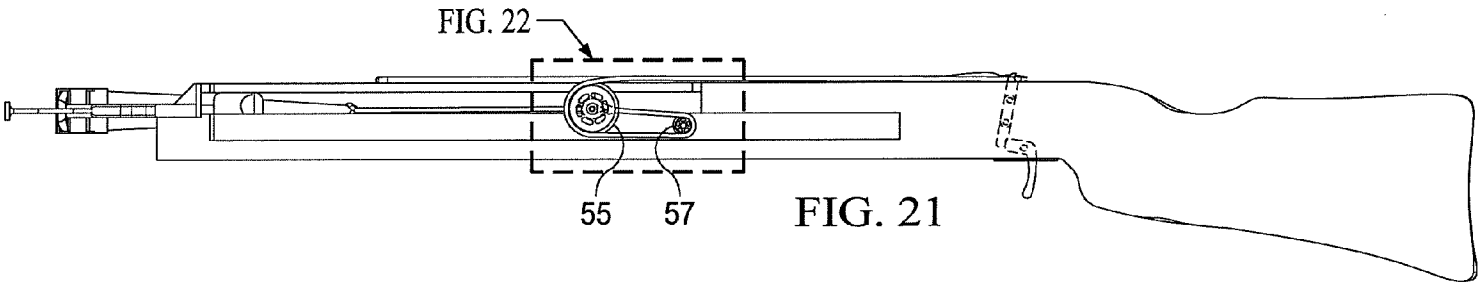
FIG. 21 is a side view, partly broken away, of another version of the powered bow of the invention having a different pulley arrangement which further leverages the launch speed of the bow to achieve a multiple level of leverage.
Figure 22:
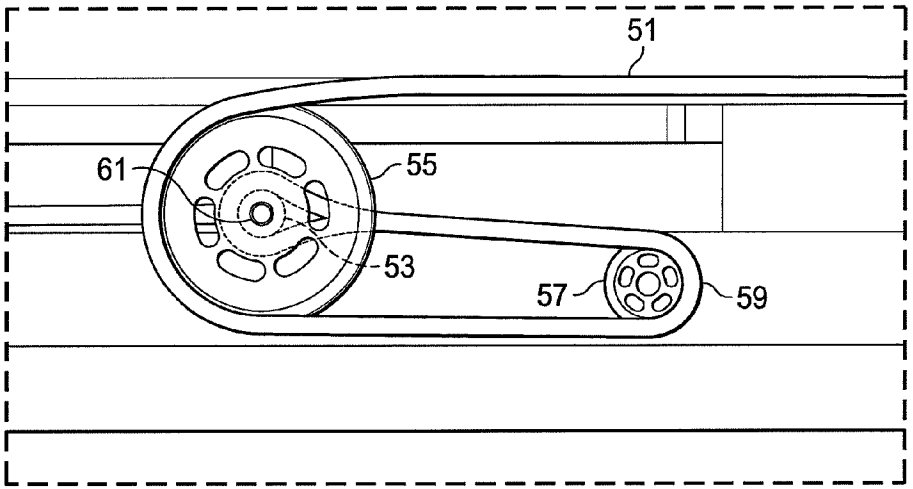
FIG. 22 is a close up view of the acceleration mechanism of the version of the bow shown in FIG. 21.

The version of the invention shown in FIGS. 1-20 describes a leveraged bow design in which approximately double the leverage is achieved. However, the principles of the invention are not limited to double leverage and, in fact, multiple levels of leverage can be achieved. FIGS. 21-22 show a bow design similar to that of FIGS. 1-10. However, in this case, the acceleration mechanism differs in one respect. In the example shown in FIGS. 21 and 22, the launch string 51 passes from a central location 53 between the traveling pulleys (pulley 55 visible in FIG. 22) around secondary pulleys 57 and then around the exterior of the traveling pulleys 55. The main power bow string again passes through the central opening 61 of the traveling pulleys. The secondary pulleys 57 turn but do not travel. When the launch string 51 is released, the traveling pulleys 55 move forward, causing an intermediate portion 59 of the launch string to pass around the secondary pulleys 55. This design, due to the presence of the secondary pulleys, in effect provides a triple leverage system for powering the bow. It should be apparent that the same system could be further adapted to provide multiple, i.e., four times the leverage, five times the leverage, etc.

The bow can use conventional cocking and release mechanisms and these are not disclosed in great additional detail in order that the novel points of the invention be more clearly illustrated in the drawings and not be obscured. These types of mechanisms will be familiar to those skilled in the relevant arts and within the skill of an ordinary workman in the relevant industries. For example, the bow can have a latch (47 in FIG. 8) which is releasably engaged with the traveling end 37 of the launch string 35. A trigger 49 pivots the latch to move the latch between the cocked and released positions (as shown schematically in FIGS. 8-10 and 18-20, respectively).

An invention has been provided with several advantages. The improved bow design of the invention provides a unique way to accelerate the string that launches the arrow. The main bow power string is used as the primary source of power going to the pulley system in order to gain more leverage. It provides a method for accelerating the arrow at a faster velocity than would otherwise be possible. The unique acceleration mechanism reduces the necessary speed of the bow by leveraging the speed. This leads to a longer lasting bow. The action works on the center of the body of the bow, rather than on the ends, providing an inherently stronger design. It is also possible to provide double, triple, four times, etc. the leverage of the bow. Other advantages will be apparent to those skilled in the relevant bow arts.

While the invention has been shown in only one of its forms, it is not thus limited but is susceptible to various changes and modifications without departing from the spirit thereof.

What is claimed is:

1. In combination, a bow for launching a projectile and a projectile, the combination comprising:

a stock having a butt region and a grip region;

a fore-end extending longitudinally from the butt region of the stock, the fore-end terminating in a pair of oppositely extending bow limbs which are connected at outer extents thereof by a main bow string of the bow, the fore-end also having an upper surface for receiving and supporting the projectile;

an acceleration mechanism located in an interior region of the fore-end, the mechanism including a launch string separate from the main bow string of the bow and a carriage which is slidably mounted on a track in an interior region of the fore-end, the carriage having an exterior surface and a central opening, the launch string having a fixed end and a traveling end, the launch string passing around the exterior surface of the carriage between the fixed end thereof and the traveling end thereof, the traveling end of the launch string contacting and being engaged with the projectile for propelling the projectile as the main bow string moves between a cocked position and a released position;

wherein the main bow string passes through the central opening of the carriage for propelling the carriage down the track between a cocked position and a released position;

whereby movement of the main bow string propels the carriage in a forward direction as the carriage moves between the cocked and released positions, movement of the carriage causing acceleration of the launch string, which, in turn, accelerates the projectile as it is launched from the upper surface of the body portion of the bow;

a latch releasably engaged with the launch string and a trigger coupled to the latch;

a projectile located on the upper surface of the fore-end;

the launch string contacting and being in engagement with a rear portion of the projectile with the launch string and the main bow string being held in the cocked position by the latch;

whereby pulling the trigger releases the latch mechanism, so that the launch string propels the projectile as the main bow string moves between the cocked position and the release position.

2. The combination bow and projectile of claim 1, wherein the projectile is an arrow.

3. In combination, a bow for launching a projectile and a projectile, the combination comprising:

a stock having a butt region and a grip region;

a fore-end extending longitudinally from the butt region of the stock, said fore-end including a pair of oppositely extending bow limbs which are connected at outer extents thereof by a main bow string of the bow, the fore-end also having an upper surface for receiving and supporting the projectile;

an acceleration mechanism located in an interior region of the fore-end, the mechanism including a launch string separate from the main bow string of the bow and a carriage which is slidably mounted on a track in an interior region of the fore-end, the carriage having an exterior surface and a transversely arranged central opening, the launch string having a fixed end and a traveling end, the launch string passing around the exterior surface of the carriage between the fixed end thereof and the traveling end thereof, the traveling end of the launch string contacting and being engaged with the projectile for propelling the projectile as the main bow string moves between a cocked position and a released position;

wherein the main bow string passes through the central opening of the carriage for propelling the carriage down the track between a cocked position and a released position;

wherein the carriage comprises a pair of pulleys arranged side-by-side on the track in the interior of the body portion of the bow, the pulleys each having an outer groove on the exterior surface thereof for receiving a portion of the launch string between the fixed end and traveling end thereof;

whereby movement of the main bow string propels the carriage in a forward direction as the carriage moves between the cocked and released positions, movement of the carriage causing acceleration of the launch string, which, in turn, accelerates the projectile as it is launched from the upper surface of the body portion of the bow;

a latch releasably engaged with the launch string and a trigger coupled to the latch;

a projectile on the upper surface of the fore-end;

the launch string being engaged with a rear portion of the projectile with the launch string and the main bow string being held in the cocked position by the latch;

whereby pulling the trigger releases the latch mechanism, whereby the launch string propels the projectile as the main bow string moves between the cocked position and the release position.

4. The combination bow and projectile of claim 3, wherein the launch string forms a loop between the fixed end and the traveling end thereof, the loop being in contact with a rear portion of the projectile for propelling the projectile as the launch string moves between the cocked and released positions of the bow.

* * * * *